US007568304B1

(12) United States Patent
Moody et al.

(10) Patent No.: US 7,568,304 B1
(45) **Date of Patent: *Aug. 4, 2009**

(54) LIGHT RAIL AND ACCESSORY RAIL MOUNT FOR VERTICAL FORE GRIP

(75) Inventors: Joseph R. Moody, Jacksonville, FL (US); Joseph D. Gaddini, Ashville, NC (US)

(73) Assignee: Grip Pod System, LLC, Jacksonville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/652,337

(22) Filed: Jan. 11, 2007

Related U.S. Application Data

(63) Continuation-in-part of application No. 11/485,762, filed on Jul. 13, 2006, now Pat. No. 7,490,429, which is a continuation-in-part of application No. 10/725,082, filed on Dec. 2, 2003, now Pat. No. 7,111,424, which is a continuation-in-part of application No. 29/267,729, filed on Oct. 20, 2006, now Pat. No. Des. 566,220, and a continuation-in-part of application No. 29/259,347, filed on May 5, 2006, now Pat. No. Des. 566,219.

(51) Int. Cl.
*F41C 23/00* (2006.01)

(52) U.S. Cl. ..... 42/72; 42/94; 42/71.01; 89/1.42; 89/37.04

(58) Field of Classification Search ..... 42/94, 42/71.01, 72; 89/1.42, 37.04
See application file for complete search history.

(56) References Cited

U.S. PATENT DOCUMENTS

| | | | | |
|---|---|---|---|---|
| 271,251 | A | 1/1883 | Leerbech et al. | 42/94 |
| 575,529 | A * | 1/1897 | Stephens | 280/300 |
| 579,529 | A | 1/1897 | Stephens | 49/320 |
| 721,425 | A | 2/1903 | Clyde | 248/170 |
| 1,295,688 | A | 2/1919 | Butler | 42/94 |
| 1,355,660 | A | 10/1920 | Farquhar et al. | 42/94 |

(Continued)

FOREIGN PATENT DOCUMENTS

WO WO 2005019762 A2 * 3/2005

OTHER PUBLICATIONS

Jane's Infantry Weapons 1976, Denis H.R. Archer, M.A., pp. 1-3.

(Continued)

*Primary Examiner*—Michelle (Shelley) Clement
(74) *Attorney, Agent, or Firm*—Brian S. Steinberger; Law Offices of Brian S. Steinberger, P.A.

(57) ABSTRACT

Devices, and methods of attaching accessory mounts to vertical fore grip handles on firearms, such as rifles. The accessory mounts can be molded to extend off of the handles. The accessory mounts can attach to the handles by interlocking plugs and slots. The accessory mount can have rails so that an accessory can attach to the rails on the accessory mount. The accessory can include lights, lasers, bayonets, sights, scopes, and the like. The vertical fore grip can be an elongated handle fixed to the firearm. The vertical fore grip can be an elongated handle that is detachable from beneath rails on the firearm. The vertical fore grip can include expandable bipod legs.

9 Claims, 13 Drawing Sheets

U.S. PATENT DOCUMENTS

| | | | | |
|---|---|---|---|---|
| 1,382,409 | A | 6/1921 | Butler | 42/94 |
| 1,580,406 | A | 4/1926 | Browning | 42/94 |
| 2,386,802 | A | 10/1945 | Johnson | 42/94 |
| 2,420,267 | A | 5/1947 | Sefried | 42/94 |
| 2,436,349 | A | 2/1948 | Adams | 42/94 |
| 2,489,283 | A | 11/1949 | Garand | 42/94 |
| 2,763,456 | A | 9/1956 | Breer | 248/186.1 |
| 2,898,137 | A * | 8/1959 | Kreske | 403/299 |
| 3,235,997 | A | 2/1966 | Stoner | 42/94 |
| 3,632,073 | A | 1/1972 | Nakatani | 248/169 |
| 4,121,799 | A | 10/1978 | Michio | 248/171 |
| 4,545,660 | A | 10/1985 | Rudolf | 396/425 |
| 4,776,124 | A * | 10/1988 | Clifton | 42/94 |
| 4,807,837 | A * | 2/1989 | Gawlik et al. | 248/125.8 |
| 5,345,706 | A | 9/1994 | Brown | 42/94 |
| 5,384,609 | A | 1/1995 | Ogawa et al. | 354/81 |
| 5,438,786 | A | 8/1995 | Hilderbrand | 42/94 |
| 6,289,622 | B1 | 9/2001 | Desch, Jr. et al. | 42/94 |
| 6,385,892 | B1 * | 5/2002 | Vendetti | 42/86 |
| 6,487,807 | B1 | 12/2002 | Kopman et al. | 42/94 |
| 6,655,069 | B2 * | 12/2003 | Kim | 42/114 |
| 6,785,997 | B2 * | 9/2004 | Oz | 42/94 |
| 7,121,034 | B2 * | 10/2006 | Keng | 42/71.01 |
| D591,822 | S * | 5/2009 | Moody et al. | D22/109 |
| 2004/0060222 | A1 * | 4/2004 | Oz | 42/146 |
| 2005/0188588 | A1 * | 9/2005 | Keng | 42/72 |
| 2005/0188597 | A1 * | 9/2005 | Keng et al. | 42/94 |
| 2005/0217161 | A1 * | 10/2005 | Haugen et al. | 42/124 |
| 2005/0241206 | A1 | 11/2005 | Teetzel et al. | 42/72 |
| 2007/0163163 | A1 * | 7/2007 | Munst | 42/85 |
| 2008/0052979 | A1 * | 3/2008 | Lee et al. | 42/94 |
| 2009/0044439 | A1 * | 2/2009 | Phillips et al. | 42/72 |
| 2009/0045304 | A1 * | 2/2009 | Faifer | 248/188.5 |

OTHER PUBLICATIONS

Brugger & Thomet Unipod, Forward grip with retractable bipod, [online] DSA Inc. Systems Second to None, DSA Order Center, 1 page, [Retrieved on Oct. 17, 2006] Retrieved from: http://www.dsarms.com/item-detail.cfm?ID=BT21830A&storeid=1&image=bt21830A.gif.

* cited by examiner

Fig.7
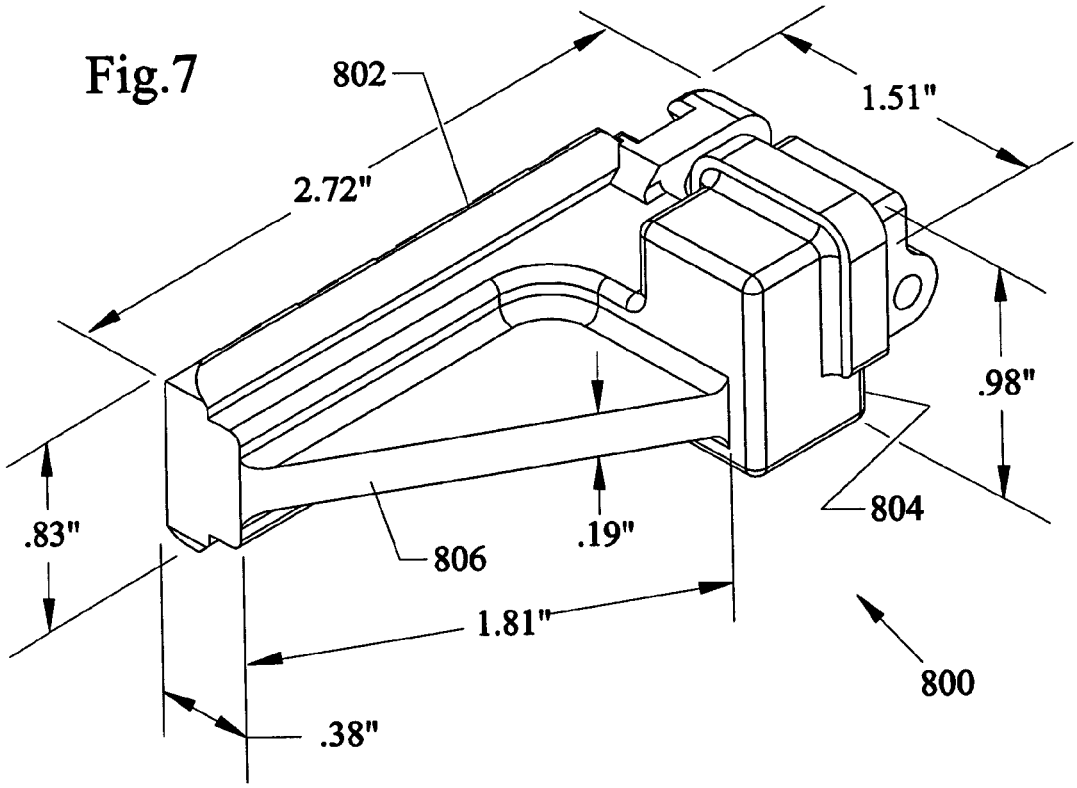
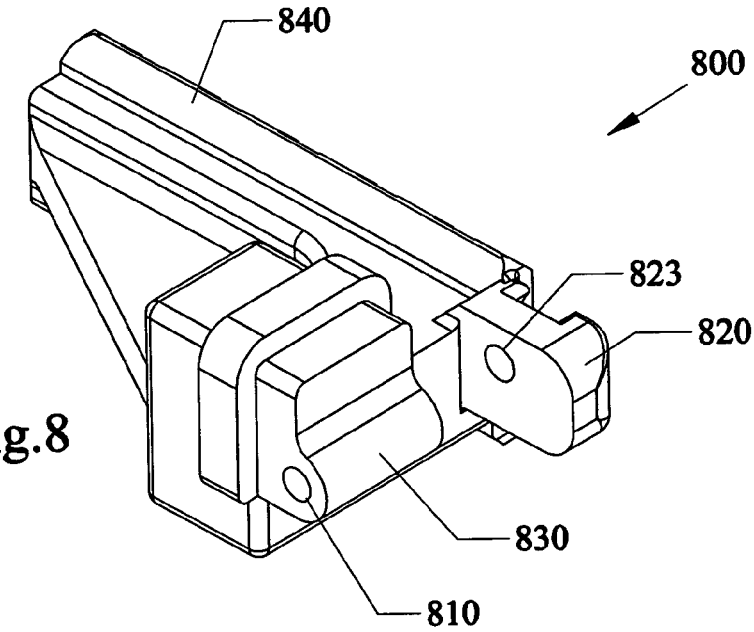
Fig.8

Fig.9
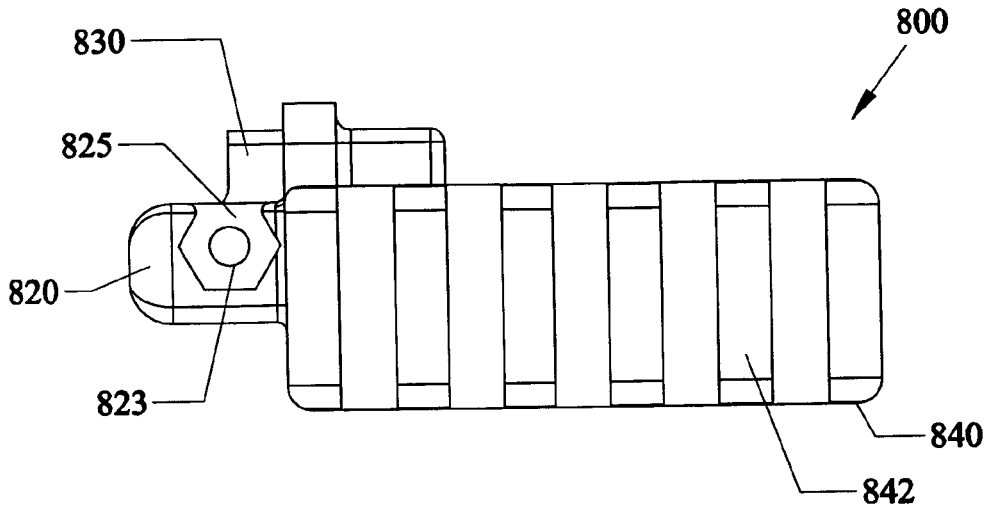
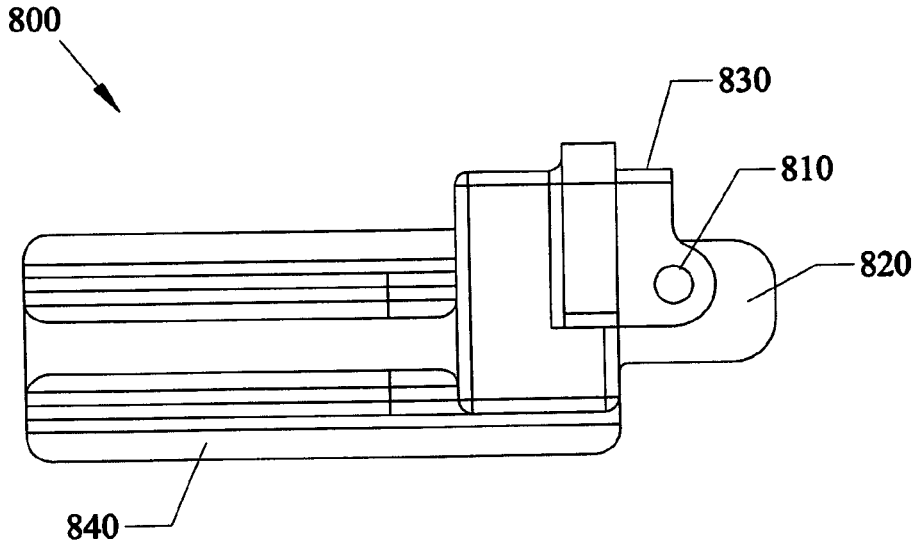
Fig.10

Fig.11
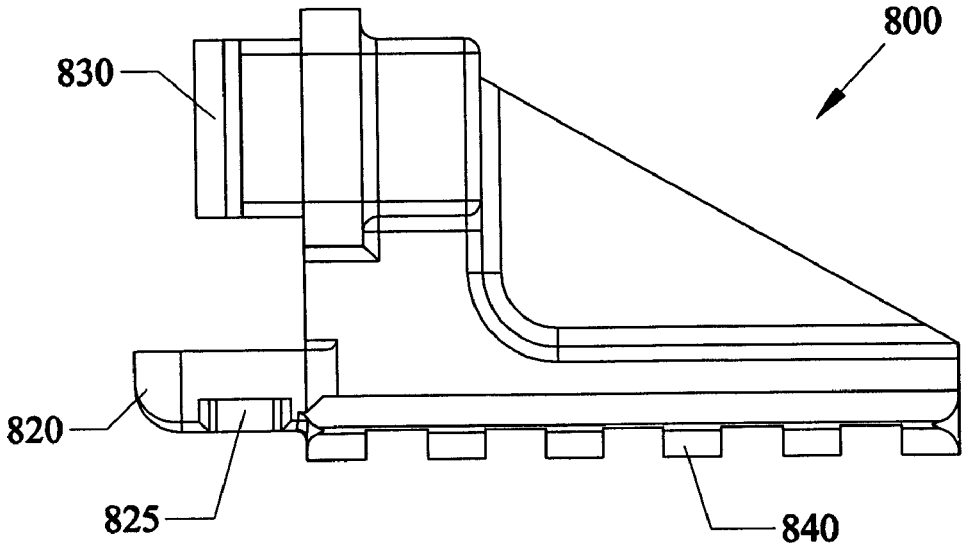
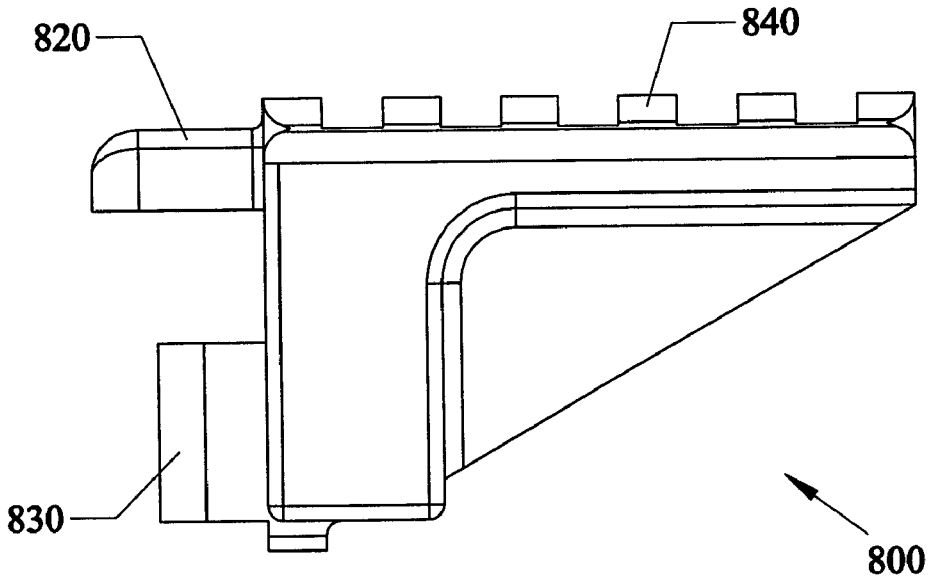
Fig.12

LIGHT RAIL AND ACCESSORY RAIL MOUNT FOR VERTICAL FORE GRIP

This invention is a continuation in part of U.S. patent application Ser. No. 11/485,762 filed Jul. 13, 2006, now allowed, which is a continuation in part of U.S. patent application Ser. No. 10/725,082 filed Dec. 2, 2003, now U.S. Pat. No. 7,111,424, U.S. Design Patent Application Ser. No. D267,729 filed Oct. 10, 2006, now U.S. Design Patent D566,220, and U.S. Design Patent Application Ser. No. 29/259,347 filed May 5, 2006, now U.S. Design Patent D566,219.

FIELD OF THE INVENTION

The present invention relates to guns and more particularly to devices, systems and methods of using and installing an accessory mount having a Picatinny rail onto a fore grip/gun handle, where the mount can support a light, laser or accessory directly from the fore grip/gun handle.

BACKGROUND AND PRIOR ART

Vertical fore grips have become popular with firearms, such as rifles. The fore grips allow the operator a handle to both support and help aim the firearm at a target. Fore grips have included standard elongated handles, that can have generally cylindrical gripping portions that can be fixed to the firearms, and the fore grips have included removable handles that can attach beneath rail type brackets underneath the firearms.

In addition to elongated handles, vertical fore grips have included other variations such as bipods that can also be fixably attached to the firearms, and be removably attached to the rail type brackets underneath the firearms.

Often the rail type brackets underneath the firearms, such as the rifles are used to support accessories such as lights. However, using a removable fore grip takes away the space that has been used for the accessory lights. Thus, operators often have to choose whether to use the removable fore grips on the bottom facing rails or use accessory lights.

Thus, a problem exists where the operator using the removable fore grip has no place to support their accessory lights causing a disadvantage for sighting targets. Thus, the need exists for solutions to the above problems with the prior art.

SUMMARY OF THE INVENTION

A primary objective of the subject invention is to provide a firearm fore grip/gun handle that allows for an accessory mount to be fixably attached directly to the fore grip handle.

A secondary objective of the subject invention is to provide a firearm fore grip/gun handle that allows for an accessory mount to be removably attached directly to the fore grip handle.

A third objective of the subject invention is to provide a firearm fore grip/gun handle with an accessory mount having rails for mounting accessories thereon.

A fourth objective of the subject invention is to provide a firearm fore grip/gun handle that can be removably mounted to rail brackets on the firearm, and has separate rail brackets for mounting accessories from the handle.

A fifth objective of the subject invention is to provide a firearm fore grip/gun handle having an accessory mount to allow flashlights to be removably attached thereto.

A sixth objective of the subject invention is to provide a firearm fore grip/gun handle having an accessory mount to allow laser sights to be removably attached thereto.

A seventh objective of the subject invention is to provide a firearm fore grip/gun handle having an accessory mount to allow bayonets to be removably attached thereto.

An eighth objective of the subject invention is to provide an existing firearm fore grip/gun handle with accessory mount for accessories to be removably attached thereto.

A ninth objective of the subject invention is to provide a bipod firearm fore grip/gun handle with accessory mount for accessories to be removably attached thereto.

The accessory mount can be used with fore grips having a firearm mounting assembly that can be self-contained or can feature adaptable mounting heads to interface with Weaver or Picatinny Rail mounts or a simple bolt attachment to a firearm. A fore grip is coupled to the mounting assembly, or can be integrated with the mounting assembly, and the fore grip is to be gripped by the hand of a user when the mounting assembly is attached or coupled to a firearm. The fore grip is used for stabilizing the firearm during firing when the user grips the fore grip.

The accessory mount can be used with fore grips having concealable and collapsible bipod legs. Alternatively, the accessory mount can be used with other types of fore grips.

The fore grip handle can include a void space or female orifice to hold an accessory switch such as but not limited to a depressible switch, for activating an accessory unit, such as but not limited to a light. A cap cover can cover the void space or female orifice. A tension fit pin can hold the cap cover in place.

A firearm fore grip with accessory mount holder, can include an elongated handle having a top end and a bottom end and outer sidewalls between the top end and the bottom end, and an accessory mount having a portion that is attached to a portion of the outer sidewalls of the handle, the accessory mount having rails for allowing an accessory to be removably attached to the rails on the accessory mount.

The accessory mount can be molded to a side portion of the outer sidewalls of the handle.

The accessory mount can be attached by a slot, and a mateable plug portion, the slot and the mateable slug portion interlocking with one another, and for allowing the accessory mount to be attachable to the handle.

The slot can be located in the portion of the outer sidewalls of the handle, and the mateable plug protrudes from the accessory mount, wherein the accessory mount attaches to the handle by the plug interlocking with the slot.

The slot can be located on the accessory mount, and the mateable plug protrudes from the portion of the outer sidewalls of the handle, wherein the accessory mount attaches to the handle by the plug interlocking with the slot. The slot and the plug portion can each have a cylindrical configuration. The slot and the slug portion can each have a rectangular configuration. The slot and the plug portion can each have threads for allowing the plug to screw into the slot.

The accessory that can be mounted to the accessory mount can be a flash light. The accessory that can be mounted to the accessory mount can be a laser light. The accessory that can be mounted to the accessory mount can be an optical sight. The accessory that can be mounted to the accessory mount can be an optical scope. The accessory that can be mounted to the accessory mount can be a bayonet.

The fore grip can be clamped about lower facing rails on the firearm, so that the rails on the accessory mount are oriented perpendicular to and below the lower facing rails on the firearm.

The rails on both the accessory mount and the lower facing rails on the firearm can each include Picatinny rails. A method of mounting accessories from the fore grips of firearms, can include the steps of providing a firearm having a vertical fore grip handle, the handle having an upper end being attached to the firearm, and a lower end, with sidewalls between the upper end and the lower end, attaching an accessory mount to a portion of the sidewalls of the handle, and attaching an accessory to the accessory mount.

The attaching step can be by molding the accessory mount to the portion of the sidewalls of the handle.

The attaching step can be by interlocking the accessory mount to the portion of the sidewalls of the handle by a slot and a mateable plug that is inserted therein.

The interlocking step can be by locating the slot on the portion of the sidewalls of the handle, and locating the mateable plug on the accessory mount.

The interlocking step can be by locating the slot on the accessory mount, and locating the mateable plug on the portion of the sidewalls of the handle.

Further objects and advantages of this invention will be apparent from the following detailed description of a presently preferred embodiment, which is illustrated in the accompanying flow charts and drawings.

BRIEF DESCRIPTION OF THE FIGURES

Referring particularly to the drawings for the purposes of illustration only, and not limitation:

FIG. 7 is a rear right perspective view of the mount of FIG. 5.

FIG. 8 is a rear left perspective view of the mount of FIG. 5.

FIG. 9 is a front view of the mount of FIG. 5 along arrow F

FIG. 10 is a rear view of the mount of FIG. 5 along arrow RV.

FIG. 11 is a top view of the mount of FIG. 5 along arrow T.

FIG. 12 is a bottom view of the mount of FIG. 5 along arrow B.

DESCRIPTION OF THE PREFERRED EMBODIMENT

Figure 2:
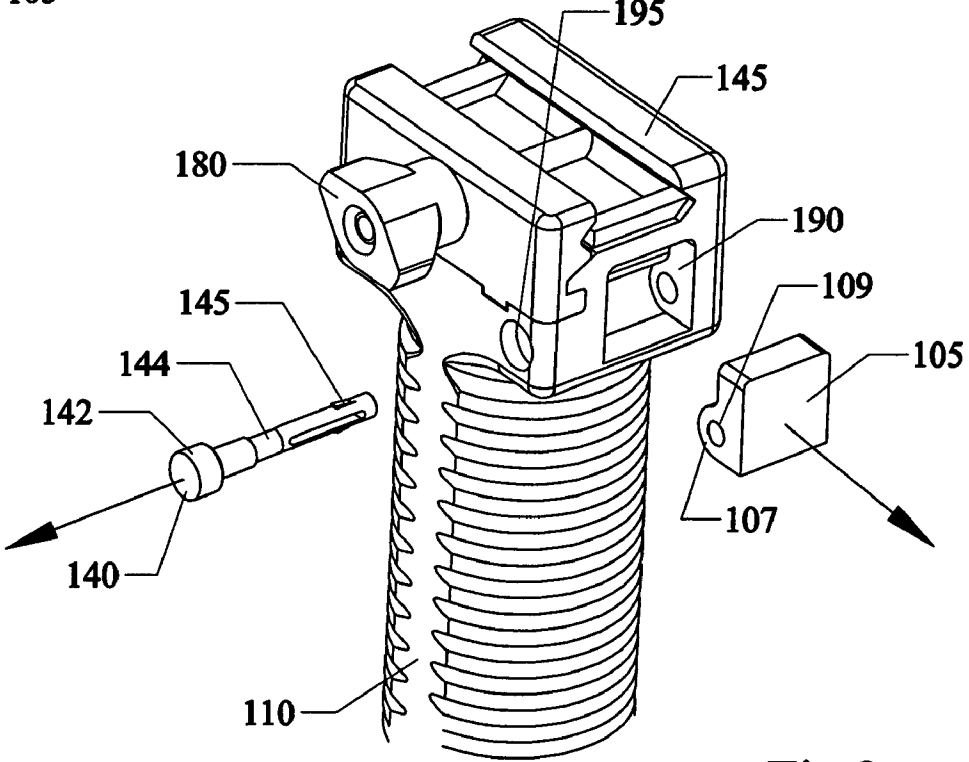
FIG. 2 is another view of the upper portion of the fore grip of FIG. 1 showing the mounting bay plug and friction pin removed.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

The invention is a continuation in part of U.S. patent application Ser. No. 11/485,762 filed Jul. 13, 2006, not allowed, which is a continuation in part of U.S. patent application Ser. No. 10/725,082 filed Dec. 2, 2003, now U.S. Pat. No. 7,111,424, U.S. Design Patent Application Ser. No. D267,729 filed Oct. 20, 2006, now U.S. Design Patent D566,220 and U.S. Design Patent Application Ser. No. 29/259,347 filed May 5, 2006, now U.S. Design Patent D566,219 all by the same inventors and assigned to the same assignee, which are incorporated by reference.

The invention can be used with the novel bipod vertical fore grip described in reference to the inventors' previous inventions.

A list of the components in FIGS. 1-23 will now be described

100. Fore grip embodiment

105. accessory mounting bay plug

107. side connection tabs on plug

109. through-holes in side tabs

110. Fore grip handle.

120. Leg(s).

140. Friction pin

142. Enlarged head

144. Elongated shaft

145. Head piece

180. Rail clamp bolt.

190. Accessory mounting bay.

195. through-holes in side walls of bay

800. Accessory rail mount.

802. Front face leg

804. Left face leg

806 Angled face end

810 Mounting screw hole.

820 Side mounting lip

823. Mounting screw hole

825. Hex nut recess.

830 Accessory bay insert boss.

840. Mounting plate member with Picatinny style mounting rails on accessory.

842. Separate feet members

850 Accessory bay plug.

860 Accessory bay.

870 Friction pin.

880 Hex nut.

890 Mounting screw.

900 Firearm/rifle

910 Picatinny rail on firearm/rifle

920 Rail mounted flashlight accessory

930 Another vertical fore grip.

Figure 19:
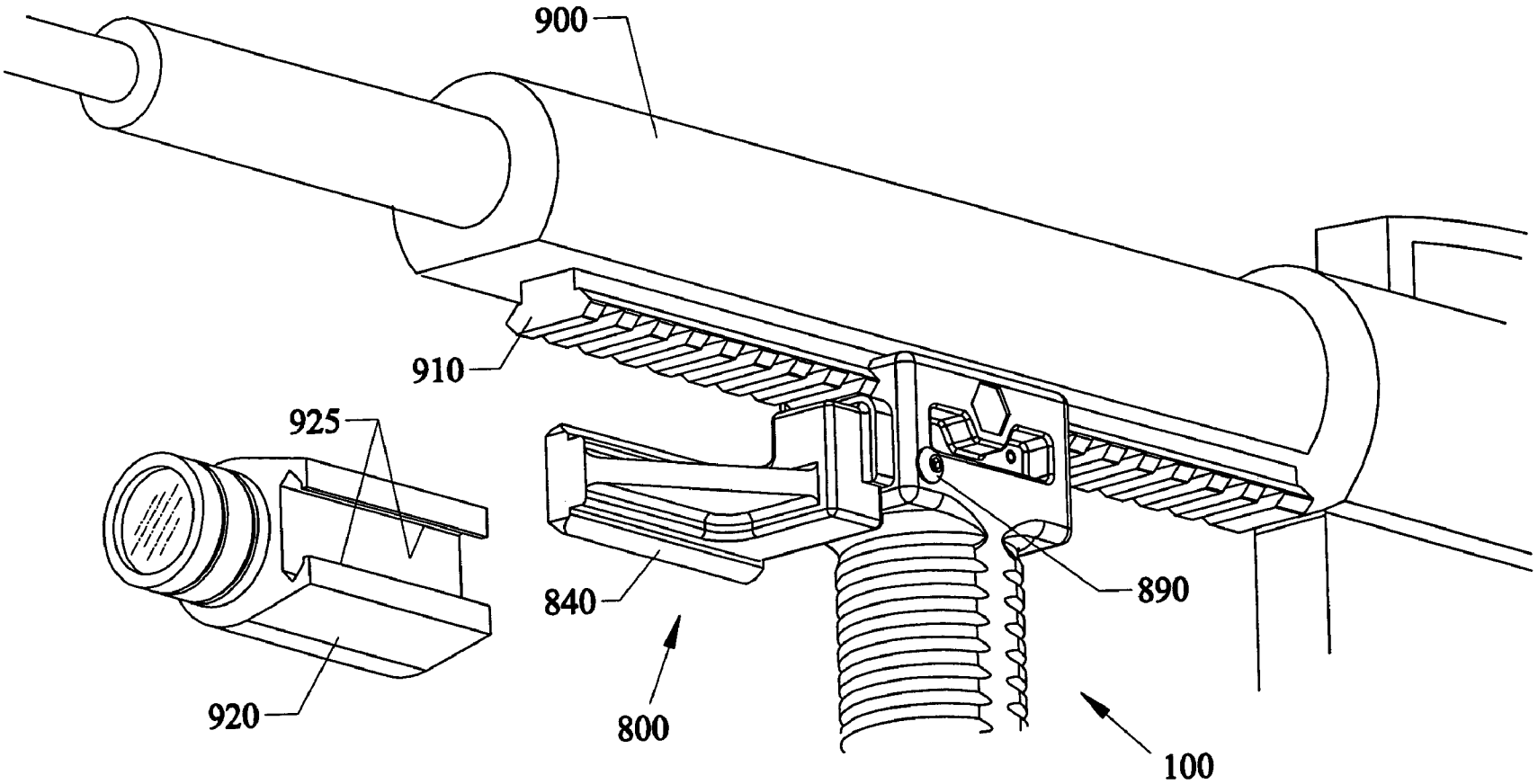
FIG. 19 is a perspective view of the fore grip of FIG. 18 with the fore grip clamped onto a rifle rail with accessory flashlight ready to be mounted onto the accessory rail mount.
Figure 21:
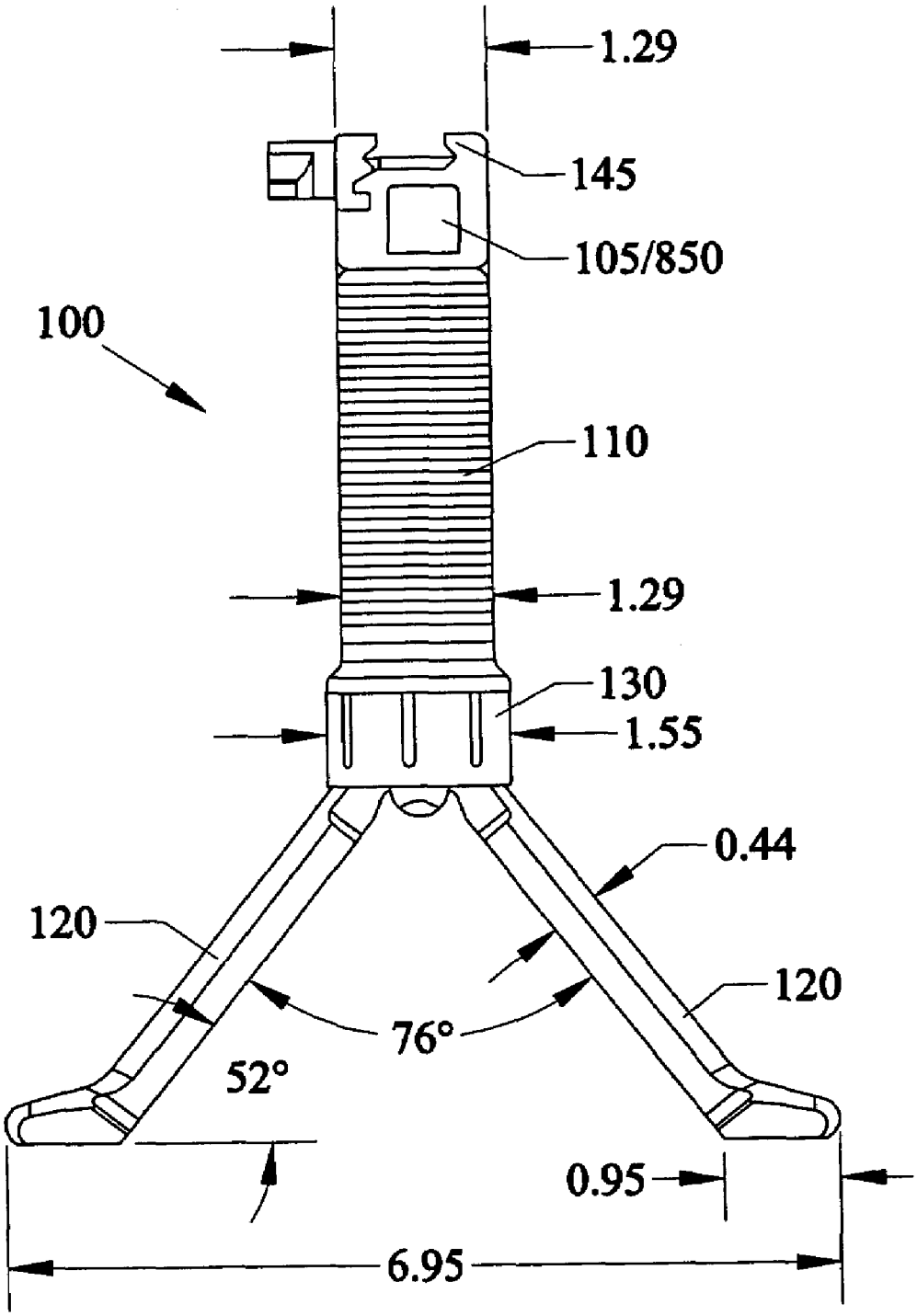
FIG. 21 is a side view of a bipod vertical fore grip that can be used with the accessory rail mount.

As shown in FIGS. 19 and 21, the accessory mount invention can be used with the inventors novel fore grip 100 that has a mounting section or end 145 having parallel rails that can be attached to rails 910, such as Picatinny rails on a firearm such as a rifle 900, and the like, by adjusting the head piece clamps with rail clamp bolt 180. The fore grip can include of a machining or a casting that utilizes aluminum or a molding that utilizes high impact resistant polymer or a composite material. The fore grip is a grip for gripping by the hand of a user when the fore grip 100 is attached to the firearm 900. Although the mounting end 3 being an integral part of the handle for illustration purposes only, it should be understood that the mounting end head piece 145 can be a separate component that is then attached by other members, such as threads or a lock screw or locking bolt to the handle 100. For illustrative purposes, the mounting end head piece uses a Picatinny mounting rail (MIL-STD-1913 rail), a mounting system widely used by military for attachment of various devices to military rifles. However, it should be understood that other methods of attachment to a firearm could be used.

As described in the parent patent applications that are incorporated by reference, the fore grip can have a handle portion 110, with bottom retaining cap 130 have a concealable and collapsible bipod legs 120. One version can have a tubular recess consisting of a first cylindrical cutout housing the bipod legs when concealed and a sliding piston that deploys the legs and a second cylindrical cutout housing a release mechanism and a void space for other accessories. The release mechanism such as a depressible button has a compression spring positioned between the piston assembly and the bottom of the first cylindrical cutout and the compression spring. The legs are connected to the bottom of the piston assembly via a hinge and spring that when released from confinement within the fore grip, causes the legs to expand outward until deployed.

Another version of the fore grip with bipod uses only one spring, wherein the legs can be gravity and/or snap/shook released from the handle by a switch (such as the depressible button) and the spring expands the legs out to the fully deployed position.

To use the fore grip, a user simply attaches the fore grip to the firearm, regardless of whether or not the bipod legs are deployed. If the legs are deployed, then the user has the option of using the gun with the legs deployed or compressing or squeezing the legs together, and pushing them upwards into the fore grip until the male part of the spring-loaded fulcrum release mechanism catches and locks the bipod legs and the piston assembly into the closed position.

Accessory Adapters

Figure 1:
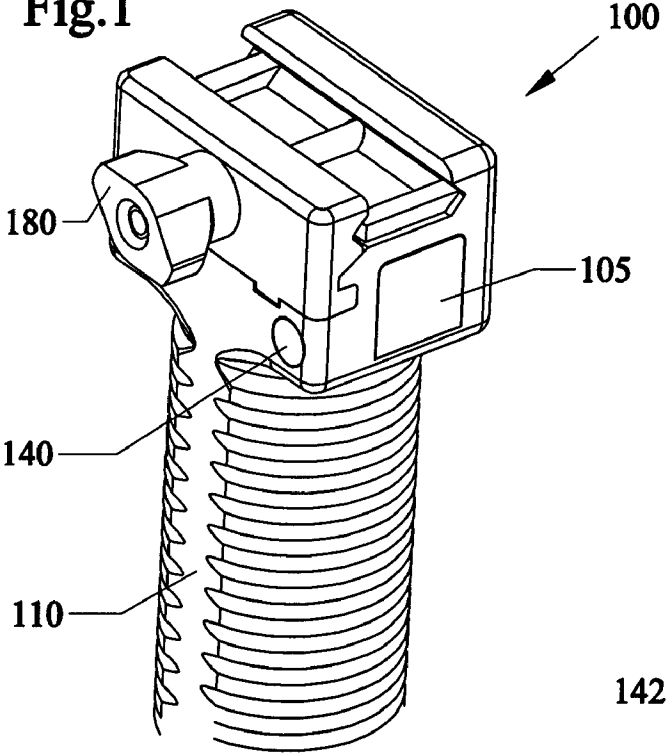
FIG. 1 is a rear perspective enlarged upper view of a fore grip showing accessory mounting bay plug.

FIG. 1 is a rear perspective enlarged upper view of the fore grip 100 showing accessory mounting bay plug 105. FIG. 2 is another view of the upper portion of the fore grip 100 of FIG. 1 showing the mounting bay plug 105 and friction pin 140 removed. The friction pin 140 can have an enlarged head 142, and an elongated shaft 144 with raised/barbed edges 145. The accessory mounting bay plug 105 can be sized to fit into accessory mounting bay 190 formed in side face of head piece 145. Through-holes 195 can be on side walls to bay 190. The plug 105 can be held in place inside of bay 190 by sliding the raised/barbed edges 145 on shaft 144 of pin 140 into through-holes 195 and holes 109 in plug tabs 107. Pulling the pin 140 by head 142 outward away from head piece 145 can allow the plug 105 to be released from bay 190.

Figures 3, 4:
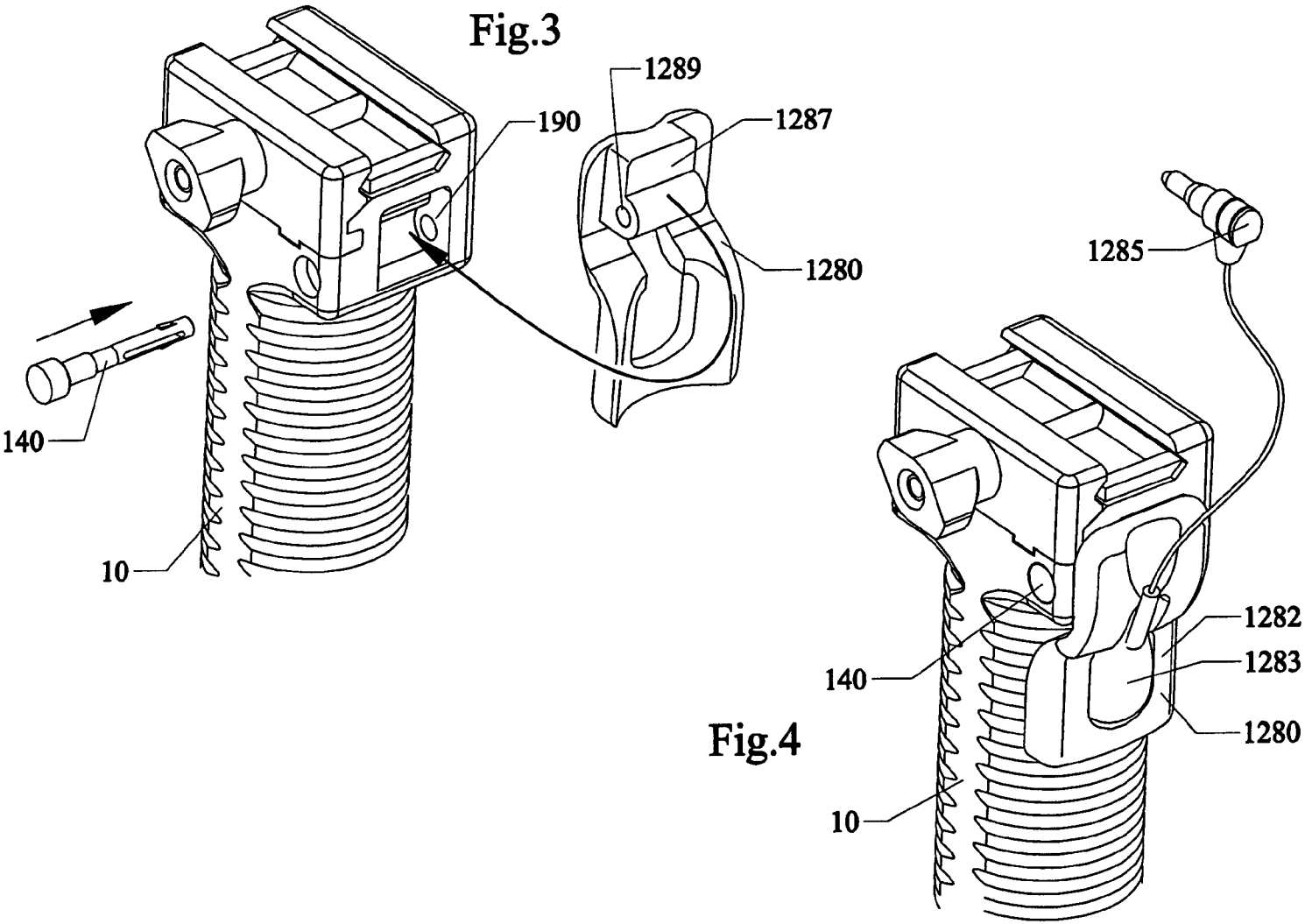
FIG. 3 is another view of FIG. 1 of an accessory switch and friction pin to install.
FIG. 4 is another view of FIG. 3 showing accessory switch and friction pin installed.

FIG. 3 is another view of FIG. 1 showing an accessory switch 1280 and friction pin 140 ready to be installed. FIG. 4 is another view of FIG. 3 showing the accessory switch 1280 and friction pin 140 installed. The back of accessory switch 1280 can have a raised plug 1287 sized to fit inside of bay 190 and held in place by pin 140 in a manner similar to that described in FIGS. 1-2. The accessory switch 1280 can have a step shaped configuration with a lower portion 1282 having a depressible power switch 1283, reachable from a finger or thumb of a user gripping about handle 110 that can turn power on and off to plug 1285 that can be hooked to accessory equipment. The accessory equipment can include but is not limited to a flashlight, laser light target finder that can also be used with the weapon the fore grip is attached to.

The novel accessory unit plug 1280 can be modified to include a depressible switch 1283 and accessory (i.e. Light, laser, and the like), such as those manufactured by Insight Technology Inc. of Londonberry, N.H., or Crimson Trace Corp. of Beaverton, Oreg.

Accessory Rail Mount

Figure 5:
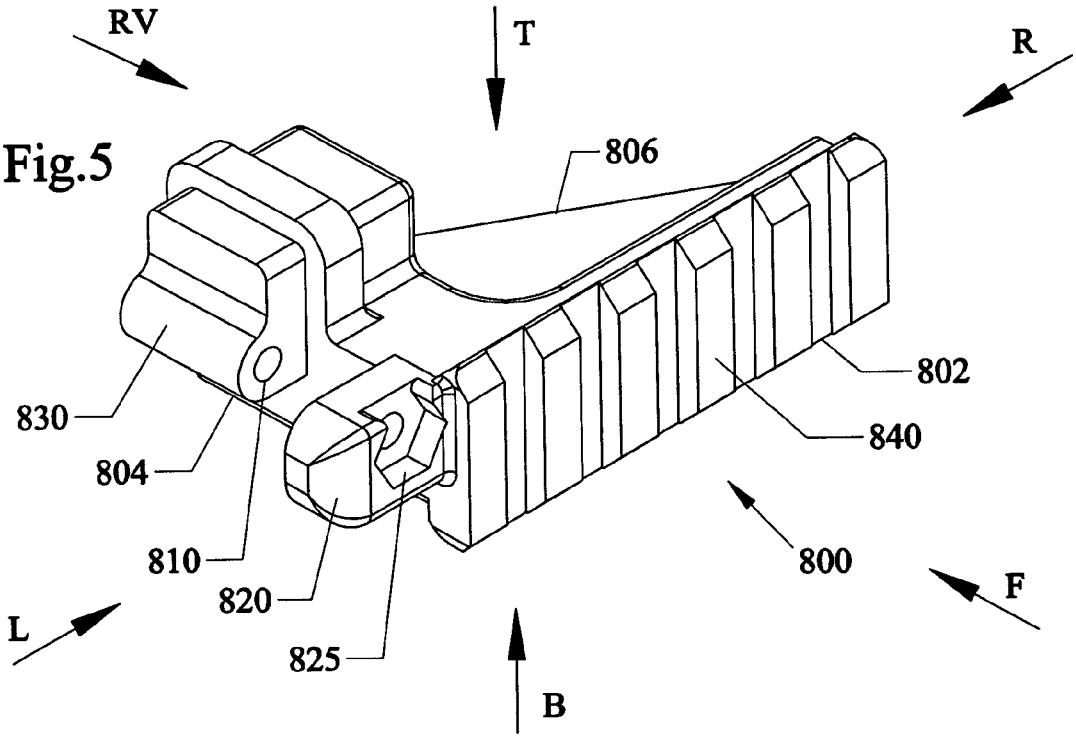
FIG. 5 is a front left perspective of an accessory rail mount for the fore grip.
Figure 6:
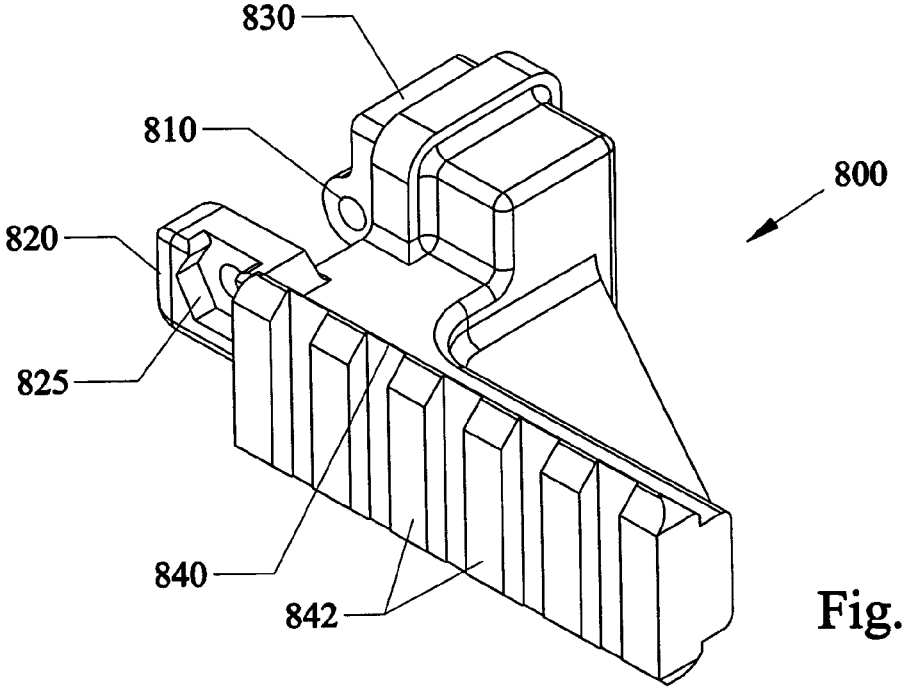
FIG. 6 is a front right perspective view of the mount of FIG. 5.
Figure 13:
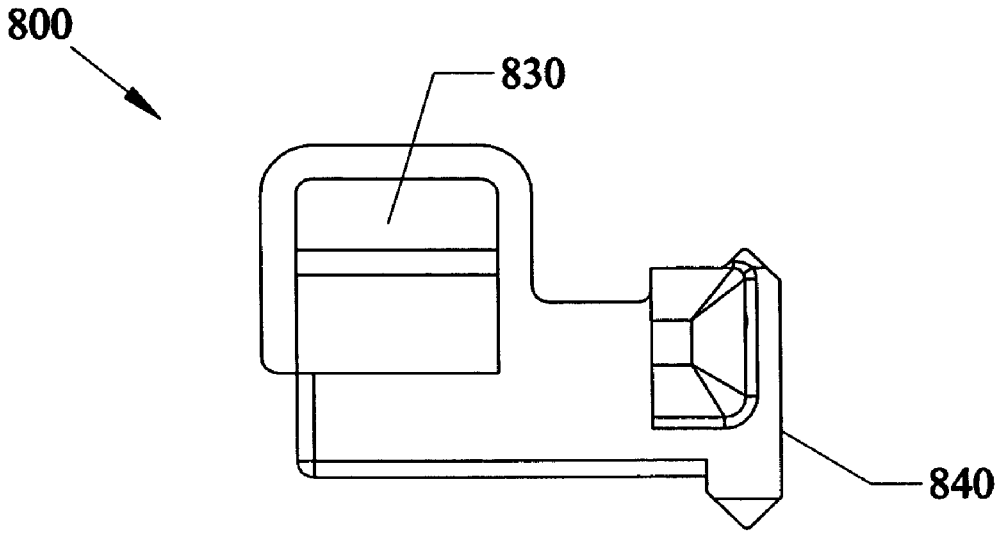
FIG. 13 is a left side view of the mount of FIG. 5 along arrow L.
Figure 14:
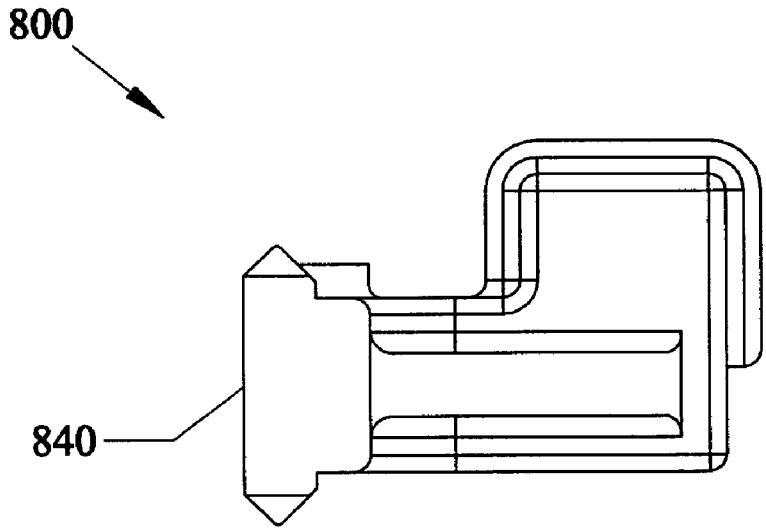
FIG. 14 is a right side view of the mount of FIG. 5 along arrow R.

FIG. 5 is a front left perspective of an accessory rail mount 800 for use with the fore grip 100. FIG. 6 is a front right perspective view of the mount 800 of FIG. 5. FIG. 7 is a rear right perspective view of the mount 800 of FIG. 5. FIG. 8 is a rear left perspective view of the mount 800 of FIG. 5. FIG. 9 is a front view of the mount 800 of FIG. 5 along arrow F. FIG. 10 is a rear view of the mount 800 of FIG. 5 along arrow RV. FIG. 11 is a top view of the mount 800 of FIG. 5 along arrow T. FIG. 12 is a bottom view of the mount 800 of FIG. 5 along arrow B. FIG. 13 is a left side view of the mount 800 of FIG. 5 along arrow L. FIG. 14 is a right side view of the mount 800 of FIG. 5 along arrow R.

Referring to FIGS. 5 and 7, the novel accessory mount 800 can be formed from injection molded plastic, and/or composite material such as glass filled nylon and/or the material described above of which the fore grip 100 is formed from. In addition, the accessory mount 800 can be optionally strengthened from metal inserts inside the body.

The accessory mount 800 can have a generally right angled triangular configuration having a front face leg 802 that can have a length of approximately 2.72", a left face leg 804 having a length of approximately 1.51", and an angled face end 806 having a length of approximately 1.81", and have a triangular plate portion with a thickness of approximately 0.19". The front face leg 802 can have a width up to approximately 0.83", and a T-shaped cross-section and thickness of approximately 0.38"

Referring to FIGS. 5-12, accessory mount 800 can include a mounting screw hole 810 in accessory bay insert boss 830, with a hex nut recess 825 in a side mounting lip 820 also having a similar mounting screw hole 823. Along the front face leg 802 can be mounting plate 840 having opposite facing edge rails. Preferably the rails can be as Picatinny rails that are found on military type firearms such as rifles, and the like. Separated feet members 842 can also be used as well, and can be formed from the same materials as the rest of the accessory mount 800 above, and/or be formed from metal materials, and the like.

Figure 16:
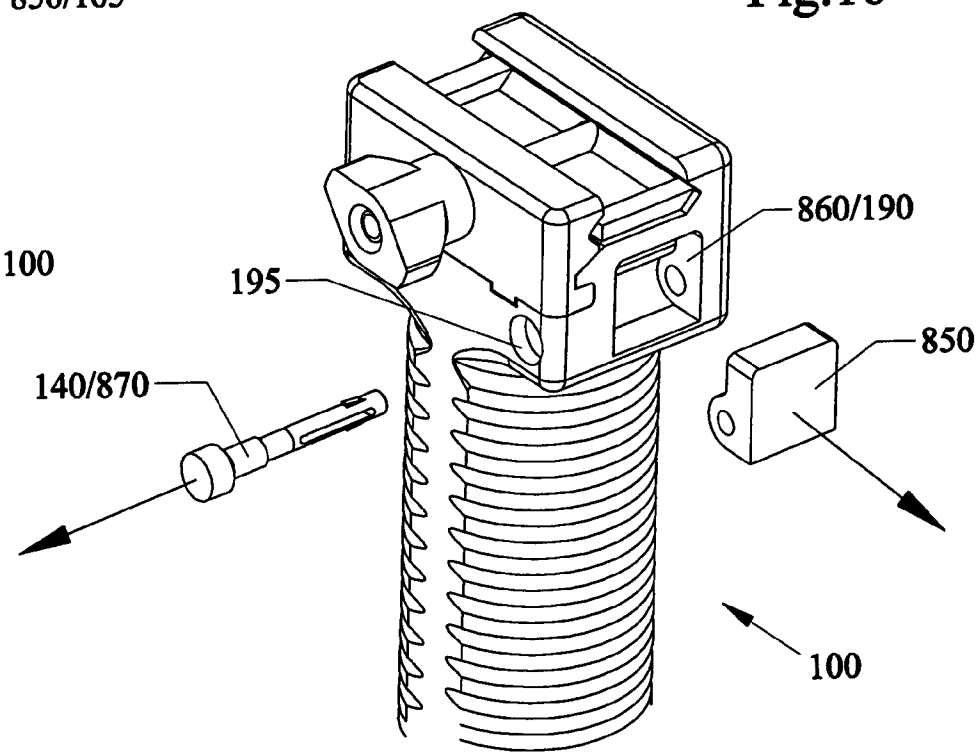
FIG. 16 is a perspective view of the fore grip of FIG. 15 showing friction pin and accessory bay plug removed exposing the accessory bay.
Figure 15:
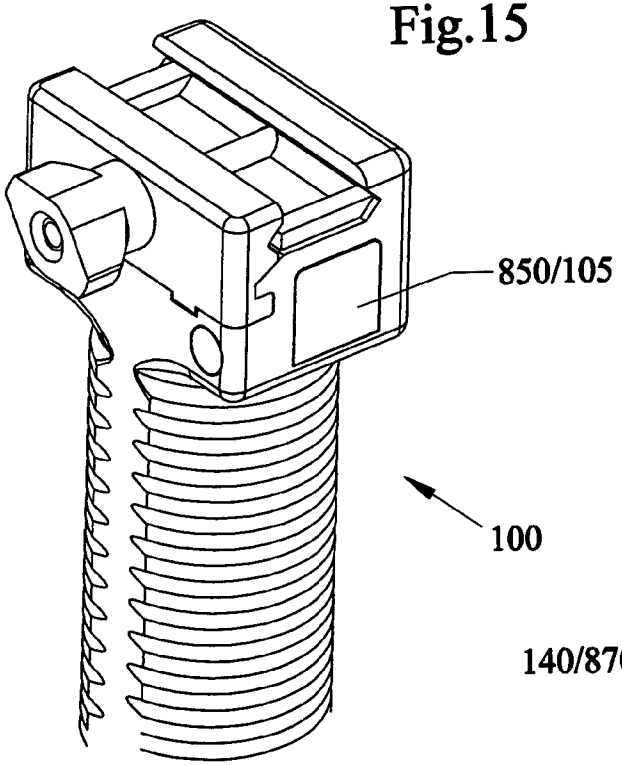
FIG. 15 is another perspective view of a fore grip such as the inventors' bipod vertical fore grip with installed accessory bay plug.
Figures 17, 18:
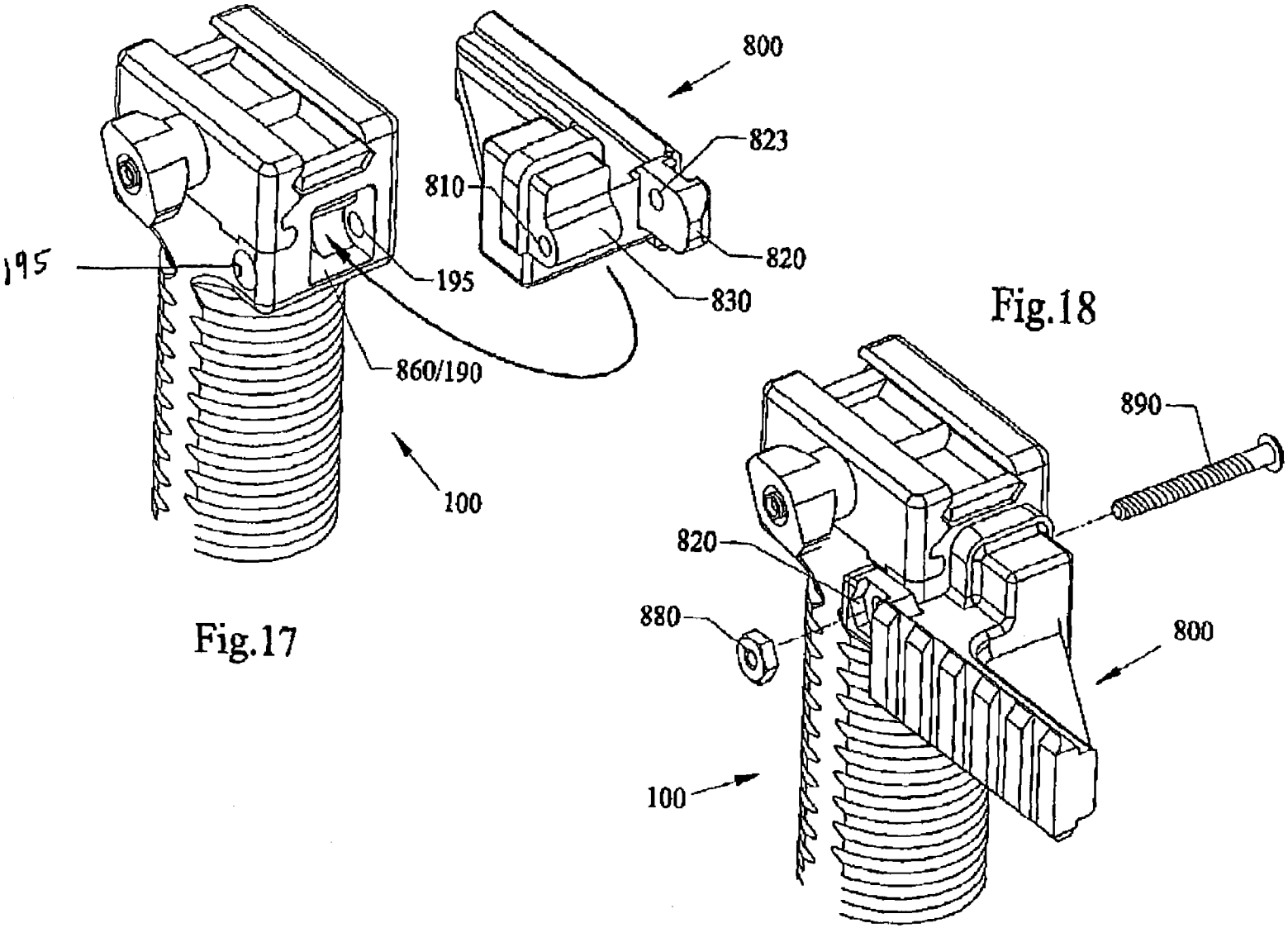
FIG. 17 is a perspective view of the fore grip of FIG. 16 with an accessory rail mount ready to install.
FIG. 18 is a perspective view of the fore grip of FIG. 17 with installed accessory rail mount being secured with a screw and a hex nut.

FIG. 15 is another perspective view of a fore grip 100 such as the inventors' bipod vertical fore grip 100 with installed accessory bay plug 850/105. FIG. 16 is a perspective view of the fore grip 100 of FIG. 15 showing friction pin 140/870 and accessory bay plug 850/105 removed exposing the accessory bay 860/190. FIG. 17 is a perspective view of the fore grip 100 of FIG. 16 with an accessory rail mount 800 ready to install. FIG. 18 is a perspective view of the fore grip 100 of FIG. 17 with installed accessory rail mount 800 being secured with a screw 890 and a hex nut 880.

Referring to FIGS. 15-18, the accessory bay plug 850/105 can be removed from the accessory bay 860/190 by removing out the friction pin 870/140 from the through-holes 195 in the sidewalls of the bay 860/190. Next, the accessory bay insert boss 830 having a shape that matches the inside of the inside of bay 860/190 can be inserted into the accessory bay 860/190 so that rails 840 extend to the side off the handle 100. A mounting screw 890 can be inserted through both mounting screw hole 823 in side mounting lip 820 and through mounting screw hole 195 in bay 860/190, and through mounting screw hole 810 in accessory bay insert boss 830. A hex nut 880 can be positioned in hex nut recess 825 on side mounting lip 820 so that the screw fastener 890 can be threaded into the nut 880 to fasten and lock the accessory mount 800 in place.

Figure 20:
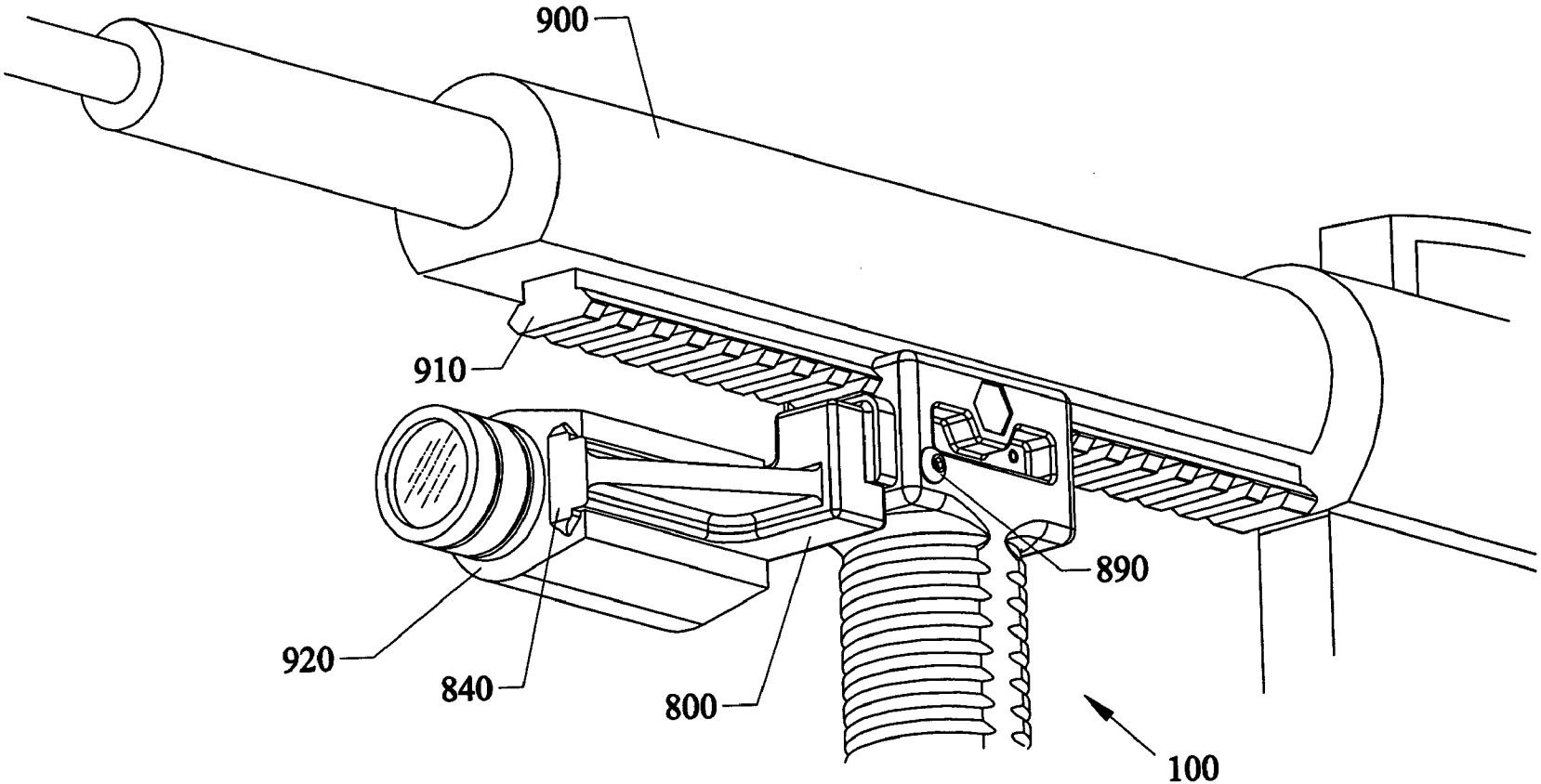
FIG. 20 is a perspective view of the fore grip of FIG. 19 with accessory flashlight mounted to the accessory rail mount.

FIG. 19 is a perspective view of the fore grip 800 of FIG. 18 with the fore grip 800 clamped onto a rifle rail 910 (such as a Picatinny rail) with an accessory flashlight 920 ready to be mounted onto the accessory rail mount 800. FIG. 20 is a perspective view of the fore grip 100 of FIG. 19 with grip edges 925 of an accessory flashlight 920 mounted to the accessory rail mount 800. A flash light such as but not limited to one manufactured by Surefire Inc. can be used.

Referring to FIGS. 19-20, the fore grip attached accessory mount rails 840 can be oriented to be perpendicular to the rail mounts 910 on the bottom of the firearm. The grip edges 925 of the accessory flashlight 920 can slide in a tight fit about the rail edges 840 on the accessory mount 800.

Although an accessory flash light is shown, other accessory lights having rails, such as but not limited to laser lights, and the like, can be used. Additionally, other accessories having rails, such as but not limited to sights and scopes can be used. Additionally, other accessories having mounting rails, such as bayonets, can be used with the novel accessory mount 800.

While the accessory mount 800 is shown with a plug boss 830, the plug can be configured to be rectangular. Still furthermore, the plug can be configured to be cylindrical, and the like.

Although the plug 830 is shown to be fastened by a screw type fastener, the plug can be fastened by a removable pin, and the like. The plug can be snap fit into the slot.

Additionally, the plug can have threaded sides and the bay can have threaded sides so that the plug screws into a slot having threads in the sidewall of the fore grip.

Additionally, the accessory mount can be fixably attached to the fore grip by being molded onto the fore grip during the manufacturing of the fore grip.

As described above, the invention can be used with the inventors' novel bipod fore grip shown in FIG. 21. A preferred embodiment can have the head piece 145 having a length of approximately 1.85 inches a width of approximately 1.29 inches and a height of approximately 1.15 inches. In a fully leg retracted/closed position, the fore grip can have a height of approximately 6.32 inches. The handle portion 110 can have a length of approximately 2.95 inches and a width of approximately 1.37 inches. The legs can have a width of approximately 0.73 inches along with the feet having a width of approximately 0.99 inches. In a fully deployed/expanded position, the fore grip can have an overall height of approximately 8.57 inches, with the legs 120 having a spread eagle angle therebetween of approximately 76 degrees, and the inside angle of the feet 128 to the rest of the legs being approximately 52 degrees. The feet can be spread apart from toe to toe at approximately 6.95 inches.

Although, the preferred embodiment lists specific dimensions, the invention can be practiced with different sized and shaped components.

The fore grip can be made from various components such as but not limited to polymeric materials, such as but not limited to plastic and/or glass filled nylon with and without metal inserts such as aluminum, galvanized metal, stainless steel, and the like Additionally, the fore grip can include void spaces where possible to decrease weight.

Although a depressible button is shown above, the invention can use other types of activation such as but not limited to toggle switches, pressure actuated switches, temperature actuated switches and the like, to release the inside legs to slide down and expand outward from beneath the housing.

Attached to Other Fore Grips

Figure 23:
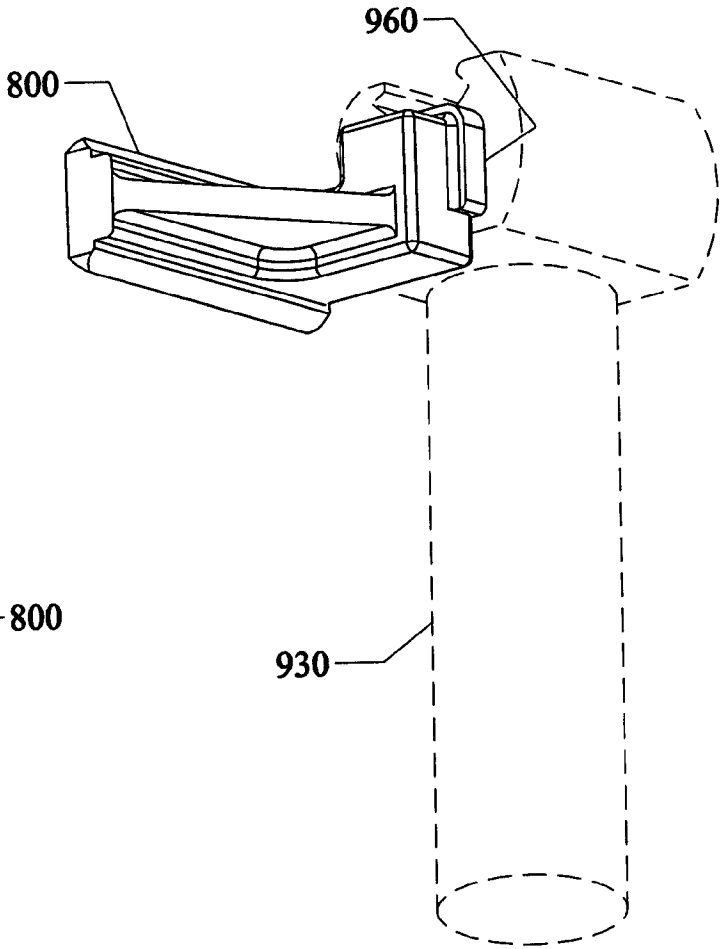
FIG. 23 is a bottom right perspective view of FIG. 22 showing the accessory rail mount attached to the vertical fore grip.
Figure 22:
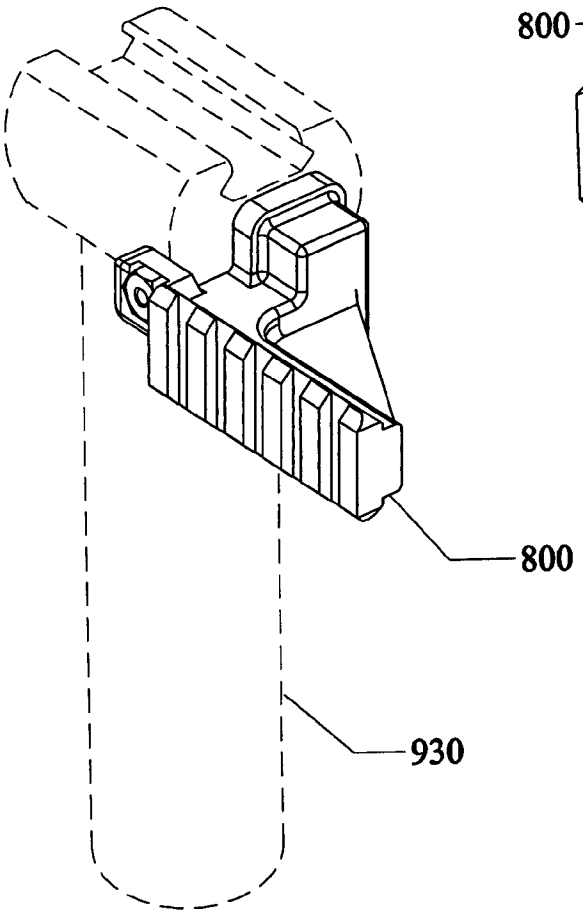
FIG. 22 is a top left perspective view of an accessory rail mount attached to another vertical fore grip.

FIG. 22 is a top left perspective view of an accessory rail mount 800 attached to another vertical fore grip 930. FIG. 23 is a bottom right perspective view of FIG. 22 showing the accessory rail mount 800 attached to the vertical fore grip 930. The invention can be used with other fore grips 930. A bay 960 similar to the bay 860 describe above can be modified so that a bay portion can be drilled out and/or cut into a sidewall portion of an existing fore grip 930.

Similar to the previously described embodiment, a plug and recess/slot can be configured to be rectangular. Still furthermore, the plug and recess/slot can be configured to be cylindrical, and the like. Snap fits can also be used.

Additionally, the plug on the accessory mount can have threads and a hole/slot in the fore grip 930 can be drilled out and have internal threads so that the plug can screw onto the fore grip 930.

Additionally, the accessory mount can be fixably attached to the fore grip by being permanently fastened thereon by adhesive such as glue, cement, and the like, after hole/slot is drilled and the plug is inserted therein.

Although the slots are shown on the fore grips, and the plugs on the accessory mount, the fore grips can be modified to include plugs and the accessory mount have slots thereon.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A removable firearm fore grip with accessory mount holder for use with firearms, comprising:

an elongated handle having a top end and a bottom end and generally cylindrical outer sidewalls between the top end and the bottom end, the top end having head member with an upper facing end having a pair of parallel clamp mounts adapted for clamping about lower facing picatinny rails underneath of a firearm, the head member having a front side face below the upper facing end, the front side face being between and below the clamp mounts, the front side face having a slot, the head member having a side wall generally perpendicular to the front side face, the side wall having a hole;

a removable one piece light rail accessory mount having a front end and a rear end and a left side and a right side, the rear end having a plug for mateably fitting and interlocking into the slot of the front side face of the head member, the accessory mount having a rearwardly facing tab perpendicular to and extending behind the rear end, the rearwardly facing tab having an opening therethrough, one of the right side and the left side of the accessory mount having a single elongated side set of picatinny rails oriented perpendicular to and below the lower facing picatinny rails on the firearm, the single elongated side set of picatinny rails is located in front of and is extending forward from the front side face of the elongated handle; and a connector for connecting the rearwardly facing tab on the accessory mount to the side wall of the head member, by passing the connector through both the opening in the tab and the hole in the side wall of the head member, wherein the side set of picatinny rails is adapted for allowing an accessory to be removably attached to the picatinny rails on the accessory mount.

2. The fore grip of claim 1, wherein the slot and the plug portion each includes:

a cylindrical configuration.

3. The fore grip of claim 1, wherein the slot and the plug portion each includes:

a rectangular configuration.

4. The fore grip of claim 1, further comprising:

a light selected from at least one of a flashlight and a laser light, for attaching to the elongated single set of picatinny rails on the accessory mount.

5. A method of mounting accessories from accessory mounts that at attached to fore grips of firearms, comprising the steps of:

providing a firearm having a set of horizontal picatinny rails beneath the firearm;

providing a removable elongated generally cylindrical vertical fore grip handle having a head member with an upper facing pair of parallel clamp mounts, the head member having a forward facing side with a slot, the head member having a side face with an hole, the side face being perpendicular to the forward facing side;

providing an accessory mount having a front end a rear end, a left side and a right side, one of the left side and the right side having an elongated single set of picatinny rails extending forward from the rear end of the accessory mount, the accessory mount having a rearwardly facing tab perpendicular to and extending behind the rear end, the rearwardly facing tab having an opening therethrough, the rear end of the accessory mount having a plug extending rearwardly therefrom clamping the upper facing parallel clamp mounts of the vertical fore grip handle about the picatinny rails underneath the firearm;

attaching the accessory mount to the handle by mateably interlocking the rearwardly extending plug of the accessory mount into the slot of the forward facing side of the head member of the handle;

additionally attaching the accessory mount to the handle by inserting a connector through both the opening in the rearwardly facing tab and the hole in the side face of the head member; and attaching an accessory to the elongated single set of picatinny rails of the accessory mount.

6. The method of claim 5, wherein the accessory includes:

a light selected from at least one of a flashlight and a laser light, for attaching to the elongated single set of picatinny rails on the accessory mount.

7. The fore grip of claim 1, wherein the accessory mount includes:

a triangular configuration with a base having the rearwardly protruding plug.

8. The fore grip of claim 1, wherein the connector is a cylindrical connector for attaching the rearwardly facing tab to a side wall of the head member of the handle, by inserting the cylindrical connector through both the opening in the tab and a hole in the side wall of the head member.

9. A removable firearm fore grip with accessory mount holder for use with firearms, comprising:

an elongated handle having a top end and a bottom end and generally cylindrical outer sidewalls between the top end and the bottom end, the top end having head member with an upper facing end having a pair of parallel mounts for clamping about lower facing picatinny rails underneath of a firearm, the head member having a front side face below the upper facing end, the front side face being between and below the clamp mounts the front side face having a slot, the head member having a side wall generally perpendicular to the front side face, the side wall having a hole;

a removable one piece light rail accessory mount having a triangular configuration with a front end and a rear end and a left side and a right side, the rear end being a base of the triangular configuration having a plug for mateably fitting and interlocking into the slot of the front side face of the head member, the accessory mount having a rearwardly facing tab perpendicular to and extending behind the rear end, the rearwardly facing tab having an opening therethrough, one of the right side and the left side of the accessory mount having a single elongated side set of picatinny rails oriented perpendicular to and below the lower facing picatinny rails on the firearm, the single elongated side set of picatinny rails is located in front of and is extending forward from the front side face of the elongated handle, the accessory mount having a rearwardly facing tab having an opening therethrough; and a connector for attaching the rearwardly facing tab to the side wall of the head member of the handle, by passing the connector through both the opening the tab and a hole in the side wall of the head member, wherein the side set of picatinny rails is adapted for allowing an accessory to be removably attached to the picatinny rails on the accessory mount.

* * * * *